US005934563A

United States Patent [19]

Gapco

[11] Patent Number: 5,934,563

[45] Date of Patent: Aug. 10, 1999

[54] WATER DISPENSING DEVICE FOR PLAY AND AMUSEMENT

[76] Inventor: Clifford E. Gapco, 10 Salzano Dr., Hamilton Square, N.J. 08690

[21] Appl. No.: 09/037,790

[22] Filed: Mar. 10, 1998

[51] Int. Cl.[6] ..... B05B 3/06

[52] U.S. Cl. ..... 239/258; 239/251; 239/279

[58] Field of Search ..... 239/251, 255, 239/266, 279, 258, 247, 245, 259

[56] References Cited

U.S. PATENT DOCUMENTS

| | | | |
|---|---|---|---|
| 2,241,092 | 5/1941 | Jurgilanis . | |
| 2,670,992 | 3/1954 | Long . | |
| 2,883,113 | 4/1959 | Horvath . | |
| 3,337,134 | 8/1967 | Bond . | |
| 3,432,099 | 3/1969 | Boniecki et al. . | |
| 4,099,670 | 7/1978 | Cole et al. | 285/302 X |
| 4,205,785 | 6/1980 | Stanley . | |
| 4,261,514 | 4/1981 | Kennard et al. . | |
| 4,382,556 | 5/1983 | Hunter | 285/302 X |
| 4,519,544 | 5/1985 | Szabo . | |
| 4,573,679 | 3/1986 | Janszen . | |
| 4,655,722 | 4/1987 | Baron et al. . | |
| 5,022,588 | 6/1991 | Haase . | |
| 5,224,652 | 7/1993 | Kessler . | |
| 5,257,739 | 11/1993 | Pascaru | 239/266 |
| 5,263,714 | 11/1993 | Rudell et al. . | |
| 5,273,214 | 12/1993 | Huffstutler | 239/279 |
| 5,480,336 | 1/1996 | Balnchard | 239/279 X |
| 5,524,935 | 6/1996 | Everts | 285/302 X |

*Primary Examiner*—Andres Kashnikow
*Assistant Examiner*—Sean P. O'Hanlon
*Attorney, Agent, or Firm*—Sperry, Zoda & Kane

[57] ABSTRACT

A device for dispensing water for play and amusement which can have the configuration thereof modified in order to spray many different types of patterns of water outwardly therefrom which includes a base member with a base conduit extending therethrough with optionally oppositely directed flow patterns for base stability and a rotatable coupling secured to the outlet of the base conduit for receiving water and for allowing rotation of a rotatable spray head assembly which is attached to said rotatable coupling. The rotatable spray head which is movable about an axis of rotation includes one or more spray section members having spray nozzle outlets which can have the outward direction of water dispensed therefrom to be controlled in such a manner as to vary the speed of rotation of the rotatable spray head assembly as well as to vary the pattern of water emitted therefrom.

19 Claims, 5 Drawing Sheets

WATER DISPENSING DEVICE FOR PLAY AND AMUSEMENT

BACKGROUND OF THE INVENTION

1. Field of the Invention

The present invention deals with the field of devices for dispensing water in decorative and amusing patterns and displays usually used as summer lawn toys by children. The configuration of the present invention provides a unique apparatus which can be combined and adjusted in various manners in order to carefully and accurately control the speed of rotation and the pattern of water dispensed from the device. Such devices are commonly used as toys for young children at the beach or in a home backyard environment.

2. Description of the Prior Art

Numerous prior art devices have been patented for dispensing water some of which are used as toys or as amusement devices such as shown in U.S. Pat. No. 2,241,092 patented May 6, 1941 to L. Jurgilanis on a "Lawn Sprinkler"; and U.S. Pat. No. 2,670,992 patented Mar. 2, 1954 to C. J. Long on a "Lawn Sprinkler"; and U.S. Pat. No. 2,883,113 patented Apr. 21, 1959 to F. J. Horvath on an "Illuminated Law Sprinkler And/Or Attachment"; and U.S. Pat. No. 3,337,134 patented Aug. 22, 1967 to F. W. H. Bond and assigned to ABC Systems, Inc. on a "Display Fountain"; and U.S. Pat. No. 3,432,099 patented Mar. 11, 1969 to K. W. Boniecki et al on a "Figure Having An Associated Spray Of Liquid Simulating Wearing Apparel"; and U.S. Pat. No. 4,205,785 patented Jun. 3, 1980 to G. Stanley and assigned to Wham-O Mfg. Co. on a "Water Play Toy With Elevatable Crown Portion"; and U.S. Pat. No. 4,261,514 patented Apr. 14, 1981 to L. V. Kennard et al on a "Bo Boy Lawn Sprinkler"; and U.S. Pat. No. 4,519,544 patented May 28, 1985 to L. Szabo on a "Portable Lawn And Garden Sprinkler System"; and U.S. Pat. No. 4,573,679 patented Mar. 4, 1986 to J. Janszen on a "Water Powered Batting Device"; and U.S. Pat. No. 4,655,722 patented Apr. 7, 1987 to W. Baron et al and assigned to Kid Biz, Inc. on a "Water Spouting Inflatable Bop Bag"; and U.S. Pat. No. 5,022,588 patented Jun. 11, 1991 to G. Haase on a "Water Toy Having Umbrella Spray Pattern"; and U.S. Pat. No. 5,224,652 patented Jul. 6, 1993 to B. Kessler and assigned to Maui Toys, Inc. on a "Lawn Water Shower"; and U.S. Pat. No. 5,263,714 patented Nov. 23, 1993 to E. Rudell et al and assigned to Elliot Rudell on a "Game With Selective Members For Releasing Water".

SUMMARY OF THE INVENTION

The present invention includes a water dispensing device for play and amusement which is capable of having the configuration thereof modified as desired in order to spray various different patterns of water therefrom and to vary the speed of rotation of portions of the device. A base member is included which defines a base conduit extending through the base member itself. The base member also defines a base inlet and a base outlet being in fluid flow communication with respect to the base conduit member to facilitate the entry of water thereinto and exiting therefrom. A rotatable coupling is also included secured to the base member and extending outwardly therefrom. This rotatable coupling preferably defines a coupling conduit therein as well as a coupling inlet and coupling outlet in fluid flow communication with the coupling conduit. The coupling inlet is engageable with respect to the base outlet to receive water under pressure therefrom for entry into the coupling conduit.

A rotatable spray head assembly is also preferably included in the apparatus of the present invention which is detachable securable with respect to the rotatable coupling in order to be rotatable with respect to the base member. The rotatable spray head assembly is rotatable about a specific axis of rotation normally extending vertically. The rotatable spray head assembly includes at least one spray section member. In those situations where multiple spray section members are included the rotatable spray head assembly is designed normally to rotate as a single unit with each spray section member rotating at the same speed.

Each of the spray section members preferably includes a sectional conduit defined therewithin for receiving water. The spray section member further defines a sectional inlet in fluid flow communication with the sectional conduit for facilitating entry or water into the sectional conduit. The spray section member additionally defines a spray nozzle outlet means in fluid flow communication with respect to the sectional conduit for dispensing water outwardly from the water dispensing device in a decorative pattern as desired. The sectional inlet is engageable with respect to the coupling outlet in order to receive water under pressure therefrom.

Preferably the rotatable spray assembly includes multiple spray section members which are oriented to dispense water therefrom in the direction at least partially laterally perpendicular with respect to the axis of rotation of the rotatable spray head assembly itself. In this manner rotational movement of the rotatable spray head assembly will be urged as a reaction force to the water dispensed from the water nozzle outlets. In the preferred configuration of the device of the present invention the base conduit will include a first lateral sector and a second lateral sector with water moving therethrough in opposite directions with respect to one another in order to enhance stability of the base member by minimizing laterally directed forces thereon caused by water traveling through the base conduit therein laterally. In a similar manner the base conduit will preferably include a first longitudinal sector and a second longitudinal sector with water moving therethrough in opposite directions with respect to one another in order to further enhance the stability of the base member by minimizing longitudinally directed forces thereon caused by water traveling through the base conduit longitudinally.

The base preferably will be of a configuration wherein the first lateral sector receives water from the base inlet and the first longitudinal sector receives water from the first lateral sector. Thereafter the second lateral sector receives water from the first longitudinal sector and the second longitudinal sector is positioned to receive water traveling through the base conduit within the second lateral sector. This configuration will form a circular path of movement of water within the base member which will equalize all forces created by reactions to water movement within the base and thereby significantly enhance the stability of the base.

The rotatable coupling of the present invention preferably includes a fixed member which is adapted to be secured to the base member such that it defines an abutment surface within the coupling conduit. The rotatable coupling further includes a rotatable member detachably securable to the rotatable spray head assembly. The rotatable member is preferably movably secured with respect to the fixed member and is adapted to contact the abutment surface when in the steady state position. The rotatable member is further adapted to move out of contact with the abutment surface responsive to water entering the coupling conduit through the coupling inlet means thereof to facilitate rotational movement of the rotatable member with respect to the fixed member and to encourage rotational movement of the rotatable spray head assembly with respect to the base. Preferably the rotatable member will also include a flange member which is capable of selective abutment with the abutment surface responsive to the absence of water movement through the coupling inlet into the coupling conduit. In the preferred configuration the fixed member of the rotatable coupling defines the coupling inlet means therewithin. As such, the flange member when positioned extending over the coupling inlet will close this inlet responsive to being in abutment with the abutment surface of the fixed member of the rotatable coupling. An alternative additional aspect of the present invention is the inclusion of an auxiliary water outlet means defined within the base member which allows the attachment of an auxiliary water device such as a spray gun or hose selectively to the device of the present invention without requiring it to be disconnected from the water source.

In the preferred configuration the present invention may have from one to four individual spray section members. These spray section members are rotatable as a unit and each include an inlet and an outlet along with an interior conduit and at least one nozzle for spraying water outwardly therefrom. Each spray section member is connected with the outlet thereof to the inlet of the spray section member immediately thereabove. The uppermost of the spray section members may include a top plug positioned within the spray section outlet thereof for sealing the outlet as desired.

It is an object of the present invention to provide a water dispensing device for play and amusement which can be configured to spray various patterns of water therefrom which is usable with respect to a standard garden hose residential water outlet.

It is an object of the present invention to provide a water dispensing device for play and amusement which can be configured to spray various patterns of water therefrom which can be used with water supplied at various pressure levels.

It is an object of the present invention to provide a water dispensing device for play and amusement which is adaptable for usage with any water supply lines having different water pressures by including the use of various nozzles with nozzle outlets of several sizes.

It is an object of the present invention to provide a water dispensing device for play and amusement which can be configured to spray various patterns of water therefrom which can be caused to rotate at various speeds for creating different visual and amusement effects.

It is an object of the present invention to provide a water dispensing device for play and amusement which can be configured to spray various patterns of water therefrom which can be configured with any number of different individual spray section members within the rotatable spray head assembly thereof.

It is an object of the present invention to provide a water dispensing device for play and amusement which can be configured to spray various patterns of water therefrom which includes a base wherein the four sectors of the reaction forces of water passing through the conduits in the base cancel one another.

It is an object of the present invention to provide a water dispensing device for play and amusement which can be configured to spray various patterns of water therefrom which utilizes a flange type water activated bearing for facilitating rotation of the rotatable spray head with respect to the base.

It is an object of the present invention to provide a water dispensing device for play and amusement which can be configured to spray various patterns of water therefrom which allows the direction of dispensing of water from each spray section member to be varied as desired.

It is an object of the present invention to provide a water dispensing device for play and amusement which can be configured to spray various patterns of water therefrom which can include removable nozzles for changing the directional orientation and size of outlets in the water dispensing nozzles.

It is an object of the present invention to provide a water dispensing device for play and amusement which can be configured to spray various patterns of water therefrom which can be utilized with an auxiliary water toy or appliance such as a hose or hose-based water gun.

It is an object of the present invention to provide a water dispensing device for play and amusement which can be configured to spray various patterns of water therefrom which easily adapts to usage with hard or soft water supplies.

It is an object of the present invention to provide a water dispensing device for play and amusement which can be configured to spray various patterns of water therefrom which includes interchangeable rotating members.

It is an object of the present invention to provide a water dispensing device for play and amusement which can be configured to spray various patterns of water therefrom which can easily be made of PVC material or other similar plastic-type materials.

It is an object of the present invention to provide a water dispensing device for play and amusement which can be configured to spray various patterns of water therefrom which has a minimum number of moving parts.

It is an object of the present invention to provide a water dispensing device for play and amusement which can be configured to spray various patterns of water therefrom which is easily maintained.

It is an object of the present invention to provide a water dispensing device for play and amusement which can be configured to spray various patterns of water therefrom which is relatively inexpensive.

It is an object of the present invention to provide a water dispensing device for play and amusement which can be configured to spray various patterns of water therefrom which can be easily repaired.

It is an object of the present invention to provide a water dispensing device for play and amusement wherein the spray pattern can be varied axially between spray section members.

It is an object of the present invention to provide a water dispensing device for play and amusement wherein the spray section members can be mutually oriented if desired to provide a non-rotating configuration.

It is an object of the present invention to provide a water dispensing device for play and amusement which can be simultaneously utilized to spray lawn and shrub areas or for other irrigation purposes.

It is an object of the present invention to provide a water dispensing device for play and amusement wherein the individual spray section members can be oriented to provided a number of different orientations for dispensing water therefrom to create many different visually appealing effects.

It is an object of the present invention to provide a water dispensing device for play and amusement which can be configured with different outlet nozzles having single or multiple outlet streams emanating therefrom.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
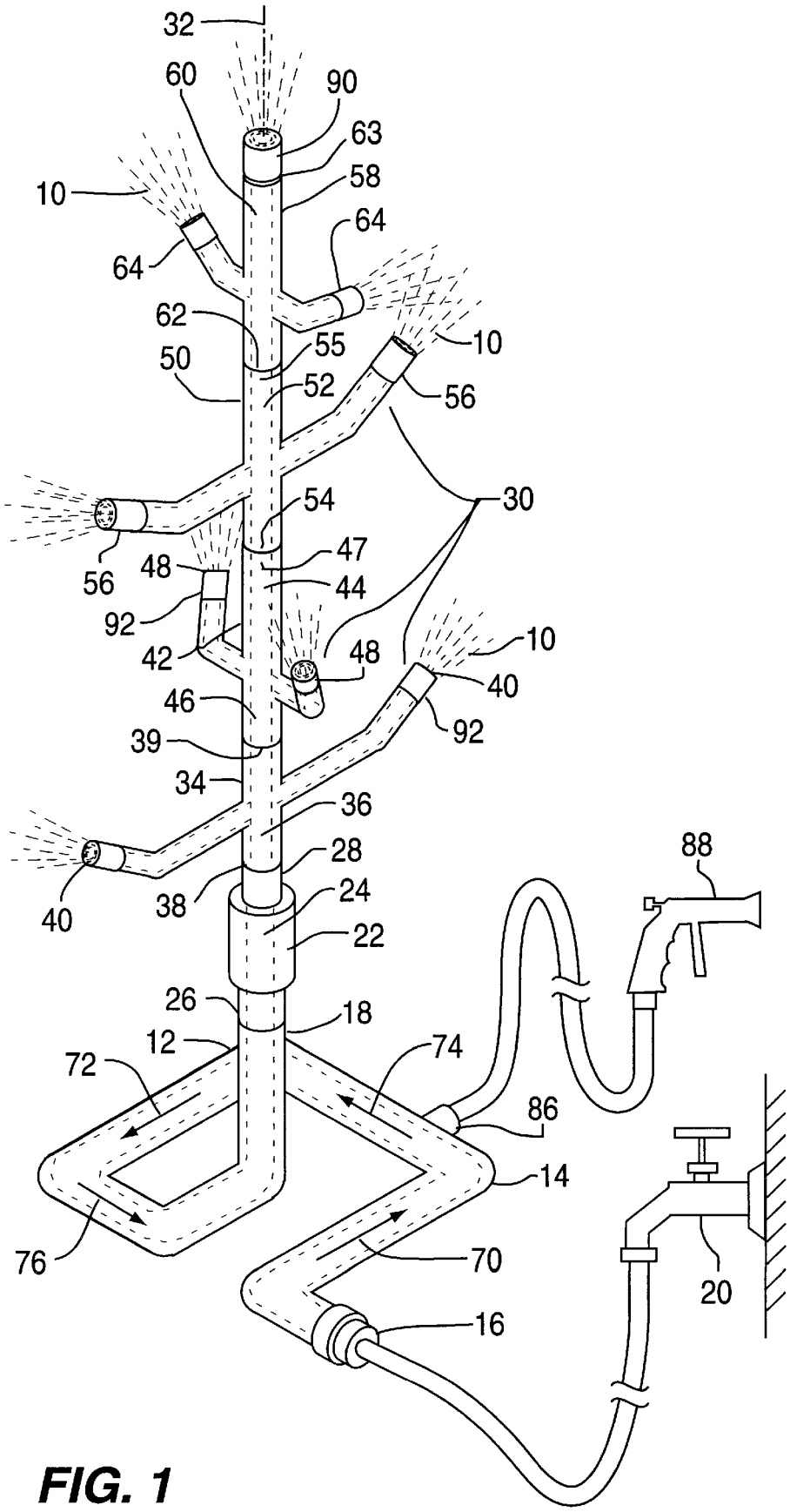
FIG. 1 is a front plan view of an embodiment of the water dispensing device of the present invention.
Figure 2:
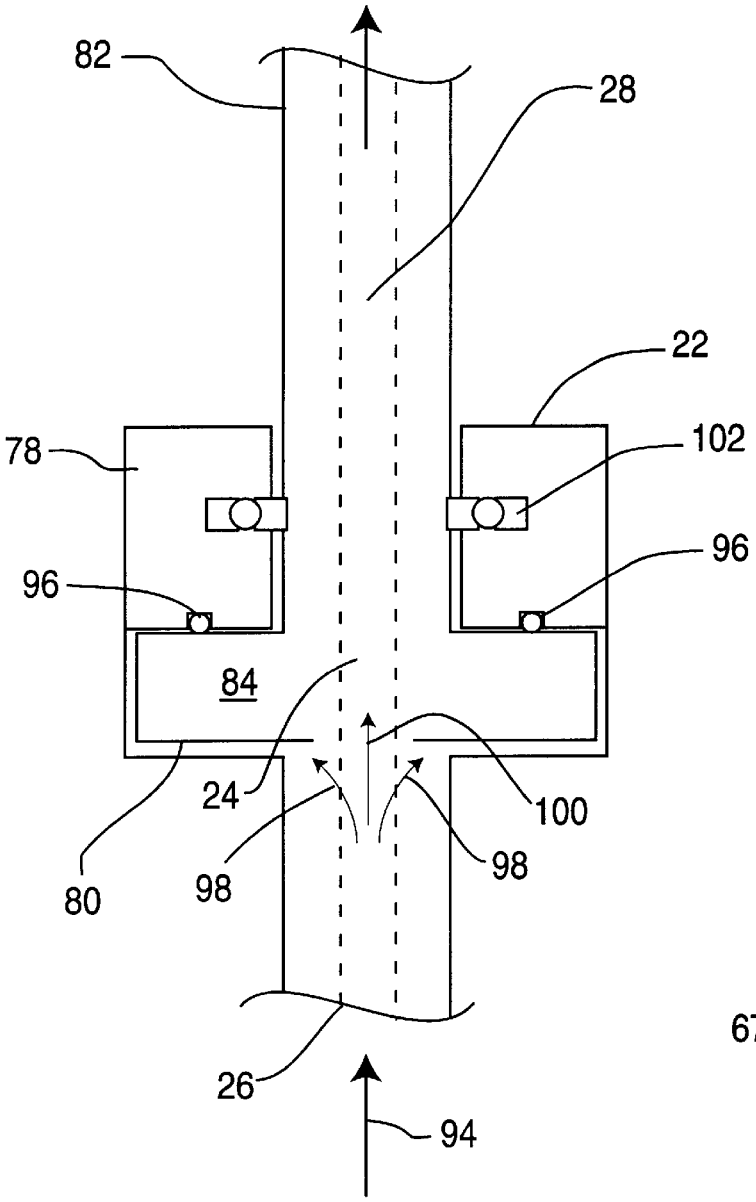
FIG. 2 is a side cross-sectional view of an embodiment of the rotatable coupling of the present invention.

The water dispensing device of the present invention is designed specifically for play and amusement and, as such, can be figured to generate various different configurations of water spray patterns 10 therefrom. The configuration includes a base member 12 which defines a base conduit 14 extending therethrough adapted to receive water under pressure from a water source 20.

Base member 12 further defines a base inlet 16 for receiving water from the source 20 for movement into the base conduit 14. A base outlet 18 is also defined in the base member 12 for supplying water therefrom. The base conduit 14 will provide enhanced stability to the base member 12 due to the significant mass and weight of the water traveling through the base conduit defined therein.

A rotatable coupling member 22 is preferably attached to the base member and defines a coupling conduit 24 extending therethrough. This coupling conduit 24 is adapted to receive water under pressure from the base member 12 and, in particular, from the base outlet 18. Rotatable coupling 22 further defines a coupling inlet 26 for allowing water under pressure to enter the coupling conduit 24 and a coupling outlet 28 for dispensing water under pressure outwardly from the rotatable coupling 22 therethrough. Preferably the coupling inlet 26 is secured to the base outlet 18 to facilitate movement of water from the base conduit 14 to the coupling conduit 24. The size of the coupling outlets will facilitate control of the rotation of the spray sections. The size of these outlet holes can be changed in order to compensate for changes in water pressure often experienced in different water supply systems.

In the preferred configuration the rotatable coupling 22 includes a fixed member 78 which is secured possibly detachably with respect to the base member 12 adjacent the base outlet 18 thereof. The rotatable coupling 22 also includes a rotatable member 82 which is rotatably mounted therein with respect to the fixed member 78. A rotatable spray head assembly 30 is detachably securable with respect to the rotatable member 82 to facilitate rotation thereof with respect to the base member 12 for dispensing water for play and amusement by the present invention.

Preferably the rotatable spray head assembly includes one or more individual spray section members such as first spray section member 34 and possibly additionally second spray section member 42, third spray section member 50 and fourth spray section member 58. One or more of these individual spray sections can be secured to the rotatable member 82 of the rotatable coupling 22 to facilitate rotation thereof with respect to the base member 12. Each of these spray section members are in fluid flow communication with respect to one another such that a supply of water under pressure is provided to each section.

Figure 6:
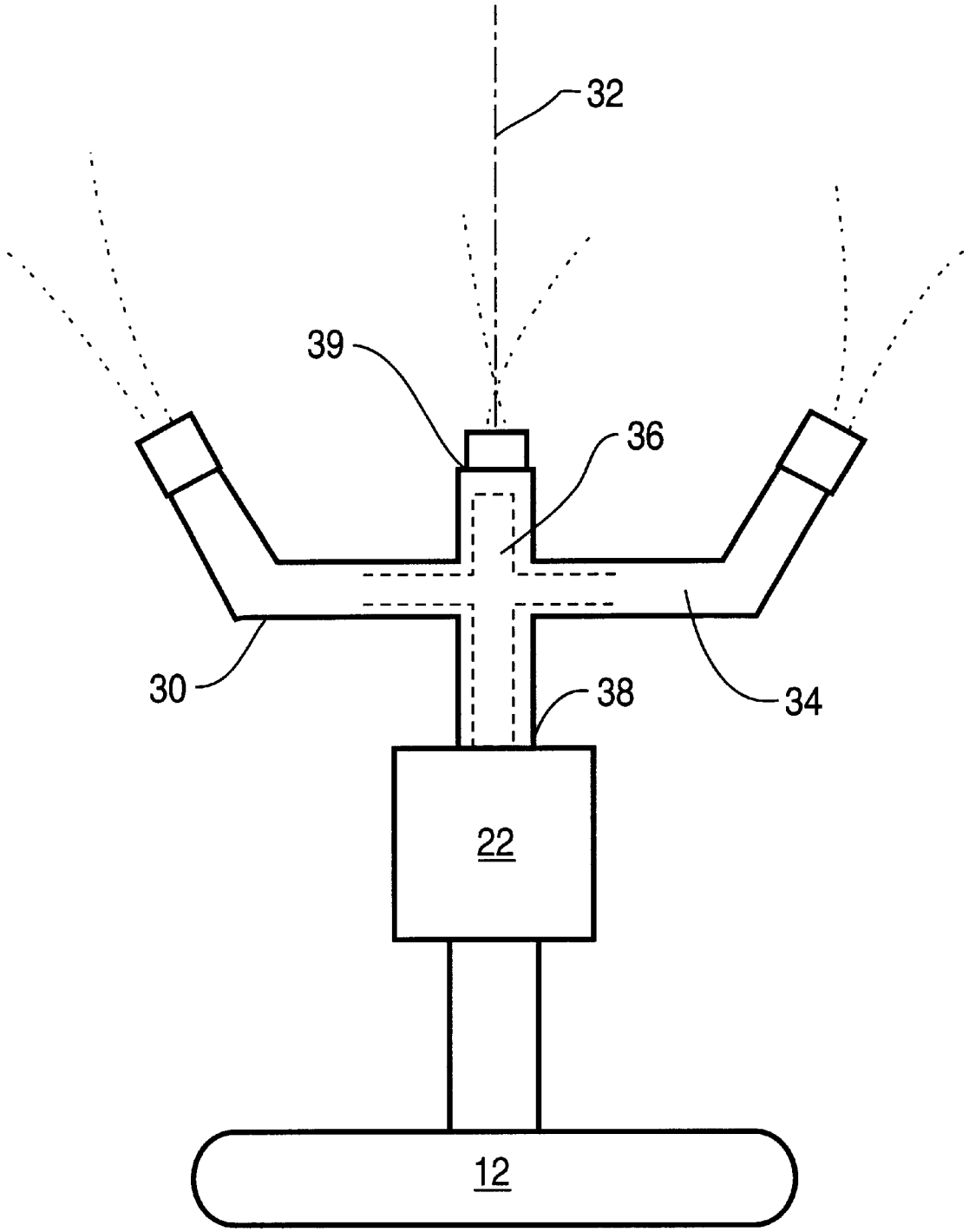
FIG. 6 is an additional alternative embodiment thereof showing a configuration with a single spray section member.

In the preferred configuration the first spray section member will include a first sectional conduit 36 extending therethrough. First spray section member 34 also defines a first sectional inlet 38 for allowing water to enter the first sectional conduit 36 and a first sectional outlet 39 for dispensing water therefrom into an adjacent spray section. First spray section member 34 also preferably includes a first spray nozzle outlet means 40 for dispensing water outwardly therefrom in a desired water spray pattern 10. In some configurations of the apparatus of this design only a single spray section member 34 need be included such as shown in FIG. 6. In such applications the single spray section member 34 can include single or multiple outlet holes defined therein to achieve the overall appearance desired or in order to control the rotation thereof.

In the preferred configuration the first sectional inlet 38 is secured to the rotatable member 82 of the rotatable coupling 22 adjacent the coupling outlet 28 thereof. In this configuration registration between the coupling outlet 28 and the first sectional inlet means 38 will facilitate the flow of water under pressure from the coupling conduit 24 into the first sectional conduit means 36.

The second spray section member 42 may be included optionally and when included will define a second sectional conduit 44 extending therethrough. This second sectional conduit 44 is adapted to receive water. A second sectional inlet 46 and a second sectional outlet 47 are both defined by the second spray section member 42 therein for facilitating the flow of water in and out with respect to the second sectional conduit 44. Second spray section member 42 further defines a second spray nozzle outlet 48 for dispensing water outwardly in a water spray pattern 10 from the second spray section member 42. In the preferred configuration the second sectional inlet 46 will be secured to the first sectional outlet 39 in order to receive water under pressure therefrom.

In a similar configuration the third spray section member 50 may optionally be included and will define a third sectional conduit 52 extending therethrough. Third spray section member 50 further defines a third sectional inlet 54 for allowing water to enter the third sectional conduit 52 as well as defining a third sectional outlet 55 for allowing water to exit from the third sectional conduit 52 to a spray section member thereadjacent. Third spray section member 50 may further define third spray nozzle outlet 56 therein for dispensing of water outwardly in a water spray pattern 10 as desired. In the preferred configuration the third spray section member 50 will be attached with respect to the second spray section member 42 such that the third sectional inlet means 54 is connected to the second sectional outlet means 47 in such a manner as to receive water under pressure therefrom.

The fourth spray section member 58 may optionally be included in the apparatus of the rotatable spray head assembly 30 of the present invention and will include a fourth sectional conduit 60 extending therethrough. Fourth spray section member 58 will further define a fourth sectional inlet 62 for allowing water to enter the fourth sectional conduit 60 and will also define a fourth sectional outlet means 63 thereof for allowing water to exit from the fourth sectional conduit 60 into an adjacent spray section member. In the preferred configuration the fourth spray section member 58 will be secured to the third spray section member 50 in such a manner that the fourth sectional inlet 62 will be connected to the third sectional outlet 55 in order to receive water under pressure therefrom. Fourth spray section member 58 will also define therein a fourth spray nozzle outlet means 64 for dispensing of water outwardly therefrom in a water spray pattern 10 as desired.

It should be appreciated that the apparatus of the present invention can be utilized with any number of individual spray section members comprising the rotatable spray head assembly 30. Use with a single spray section member such as first spray section member 34 is certainly possible and usage with as many as four or more individual spray section members coupled to one another through the inlets and outlets thereof is certainly within contemplation of the present invention in order to spray any one of a great variety of different water spray patterns 10 achievable with the apparatus of the present invention.

Figure 3:
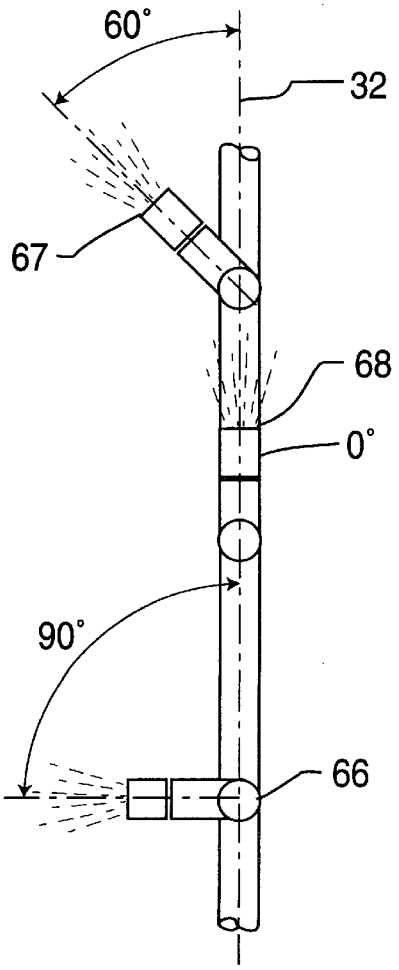
FIG. 3 is a side plan view showing alternate angular configurations of an embodiment of the spray section members of the rotatable spray head assembly of the present invention.
Figure 4:
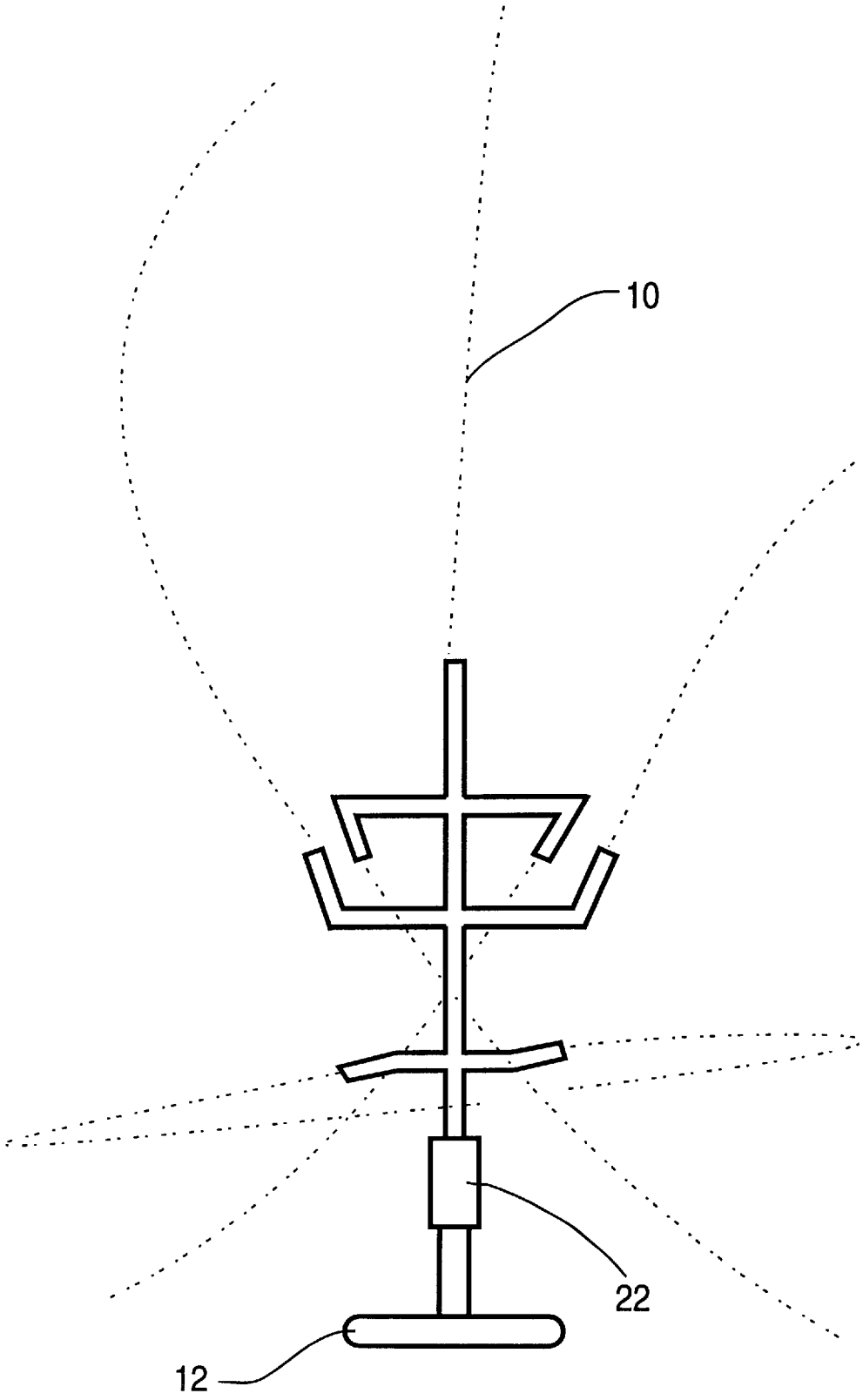
FIG. 4 is an alternative embodiment of the water dispensing device for play and amusement of the present invention.
Figure 5:
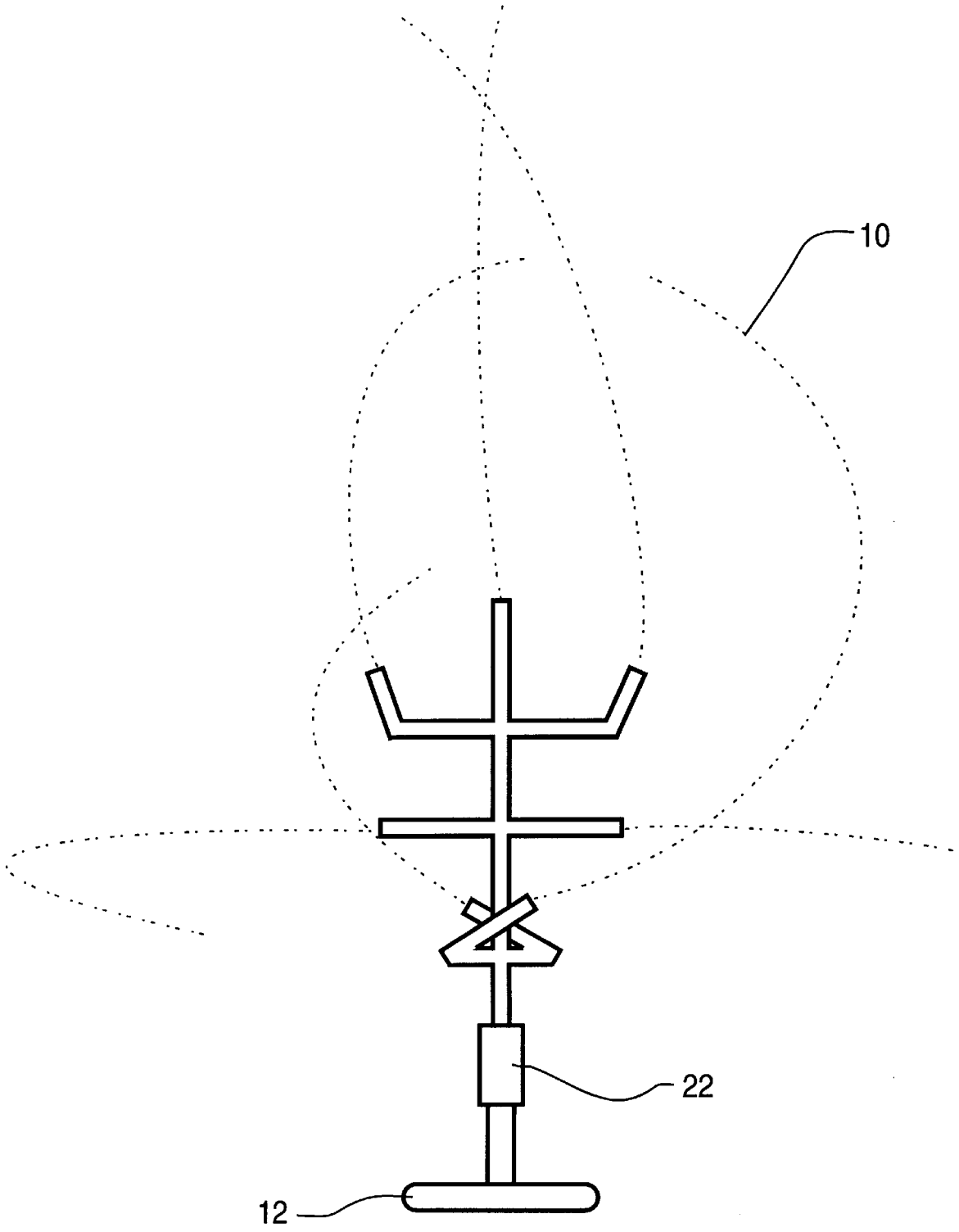
FIG. 5 is a further alternative embodiment thereof.

The individual spray nozzle outlets of the present invention shown in FIG. 1 as 40, 48, 56 and 64 are movable with respect to the individual spray section members themselves in order to vary the water spray pattern 10 dispensed from the device of the present invention. This adjustability can be achieved by many means. However, the arms of the individual spray section members as shown in FIG. 1 can be movable to vary the angle at which the water is dispensed from the spray nozzle outlets. This angular orientation is very important in determining the pattern but is even more important in determining the speed of rotation of the rotatable spray head assembly 30 with respect to the base member 12. This speed of rotation is determined by the angular orientation of these outlets with respect to the axis of rotation 32 of the rotatable spray head assembly 30. Those spray nozzle outlets which dispense water in a spray pattern vertically perpendicular with respect to the axis of rotation will impart no rotational force to the rotatable spray head assembly 30. As seen best in FIG. 3 reference numeral 68 shows an outlet which is oriented vertically perpendicular with respect to the axis of rotation 32. The zero degree angle shows that this dispensing member is imparting no angular force to cause rotational movement of the rotatable spray head assembly 30. In the alternative, however, the laterally perpendicularly oriented outlet 66 is oriented laterally perpendicular with respect to the axis of rotation 32. This angle is shown as 90 degrees in the FIG. 3 configuration. Clearly the speed of rotation for the rotatable spray head assembly 30 is an important characteristic of the water dispensing device of the present invention since it has such an important impact on the water spray pattern 10 dispensed therefrom. Reference numeral 67 refers to an outlet oriented 60 degrees as shown in FIG. 3 with respect to the axis of rotation 32. This dispensed water is partially oriented laterally perpendicular and partially oriented vertically perpendicular with respect to the rotation axis 32 and, as such, will impart a partial force to urge rotational movement of the rotatable head assembly 30.

This imparting of rotational force to the rotatable spray head assembly 30 is an important aspect of the present invention since the speed of rotation can be accurately controlled by varying the angular orientation of the spray nozzle outlet with respect to the axis of rotation 32 of the rotatable spray head assembly 30. The amount of force required to rotate the rotatable spray head assembly 30 will vary dependent upon the mass of the assembly which itself will vary dependent upon the number of individual spray section members included in the operation of the water dispensing device at a given time and the orientation and positioning thereof.

Due to the rotational capability and the significant height of the water dispensing device of the present invention, it is preferable that the base be of a very stable configuration. This is achieved in the present invention by including four individual sectors in the base each of which includes water moving through in an oppositely oriented direction to cancel out any lateral force which would tend to de-stabilize the base. In particular water admitted from the water source 20 will enter the base member 12 through the base inlet 16. Base inlet 16 preferably allows this water to move directly into a first lateral sector 70. The water then moves into a first longitudinal sector 74 and thereafter into the second lateral sector 72 and finally through the second longitudinal sector 76 to the base outlet 18 for movement into the rotatable coupling 22 through the coupling inlet 26. In this preferred configuration the first lateral sector 70 will be oriented in the diametrically opposite position with respect to the second lateral sector 72. In this manner the lateral forces on the base created through the first lateral sector 70 will be equalized and cancelled out by the laterally directed forces on the base created by water passing through the second lateral sector 72. In a similar manner the first longitudinal sector 74 will preferably be diametrically oppositely oriented with respect to the second longitudinal sector 76. In this configuration water passing through the first and second longitudinal sectors 74 and 76 will exert forces which equalize and cancel out one another as sensed by the base member 12. This overall configuration will achieve a very stable and secure base which is necessary due to the extensive array of the rotatable spray head assembly 30 in some orientations such as shown in FIG. 1. This equalization of forces as well as the weight created by the water itself while passing through the base will achieve a stable overall design which has been found to be very necessary in the water dispensing device of the present invention in order to make the water display patterns 10 as desired achievable.

The rotatable coupling 22 will preferably be of a configuration wherein the fixed member 78 thereof defines an abutment surface 80 preferably facing upwardly vertically therefrom. This abutment surface 80 will also preferably be positioned such that it defines the coupling inlet 26. Rotatable member 82 of the rotatable coupling 22 will preferably include a flange member 84 which in the steady state position will be adapted to rest upon the abutment surface 80, positioned therebelow in this embodiment. With this configuration as water moves through the base conduit 14 and the base outlet 18 it will travel through the rotating member 82 in the flow through direction indicated by directional arrow 100. Also, however, due to the pressure of the water, it will also move to some extent in a lateral direction as shown by directional arrows 98 in such a manner as to impinge upon the lower surface of flange member 84 for effectively lifting thereof out of contact with the abutment surface 80 therebelow. This movement caused by the water pressure will facilitate rotational movement of rotatable member 82 with respect to the fixed member 78 during times of water spraying by the water dispensing apparatus of the present invention since abutting contact with the abutment surface 80 no longer exists under these operating conditions. Also a sealing member such as an 0-ring 96 can be positioned between the rotatable member 82 and the fixed member 78 to prevent water flow therebetween. Also a bearing member 102 can be positioned between the fixed member 78 and the rotatable member 82 to enhance rotational movement therebetween. Bearing member 102 can be of any conventional bearing configuration and can be made from metal, plastic or any other suitable material.

The present invention preferably also includes an auxiliary outlet 86 defined in the base member 12 to which an auxiliary water device 88 such as a spray gun or hose can be attached for play or utilitarian purposes as needed.

Since the individual spray sectional members 34, 42, 50 and 58 of the present invention are connectable with respect to one another adjacent the inlets and outlets thereof, it is preferable that the uppermost member of any array of such spray section members that forms the rotatable spray head assembly 30 have a means for sealing the sectional outlet of the uppermost member. In the configuration shown in FIG. 1 the fourth sectional outlet means 63 needs to be sealed in order to maintain water pressure and allow dispensing of the water spray pattern 10 as desired. For this purpose a top plug member 90 may be positionable therein. This plug member 90 can be utilized regardless of the actual number of individual spray section members being utilized but in the configuration shown in FIG. 1 it will be placed in the uppermost outlet of the fourth spray section member 58. In a configuration of the rotatable spray head assembly 30 where only the first spray section member 34 is being utilized then the top plug member will be positioned in the first sectional outlet 39 thereof. This top plug member 90 may also include a plurality of apertures therein to facilitate dispensing vertically upwardly from the rotatable spray head assembly 30.

It should be appreciated that the present invention may include detachable tips 92 which define the spray outlet nozzles of the spray section members. Removal and replacement of these tips 92 can vary the orientation of the tips with respect to the spray section members and also can be performed in order to vary the size outlet nozzles. Both of these variations have significant impact on the overall final water spray pattern 10.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A water dispensing device for play and amusement for spraying various different patterns of water therefrom comprising:

A. a base member defining a base conduit means extending therethrough, said base member further defining a base inlet means and a base outlet means therein in fluid flow communication with respect to said base conduit means to facilitate entry of water into said base conduit means through said base inlet means to provide additional mass and enhanced stability to said base member due to the water traveling within said base conduit means, said base outlet means facilitating exit of water from said base conduit means, said base inlet means being adapted to be connected to a source of water under pressure;

B. a rotatable coupling means secured to said base member and extending outwardly therefrom, said rotatable coupling means defining a coupling conduit means therewithin and a coupling inlet means and a coupling outlet means therein in fluid flow communication with respect to said coupling conduit means, said coupling inlet means being engageable with respect to said base outlet means to receive water under pressure therefrom for entry into said coupling conduit means, said rotatable coupling means including A. a fixed member adapted to be fixedly secured to said base member, said fixed member defining an abutment surface within said coupling conduit means; and B. a rotatable member being movably secured with respect to said fixed member and adapted to contact said abutment surface in the steady state position, said rotatable member being adapted to move out of contact with said abutment surface responsive to water entering said coupling conduit through said coupling inlet means thereof to facilitate rotational movement thereof with respect to said fixed member; and C. a rotatable spray head assembly being detachably securable with respect to said rotatable member of said rotatable coupling means to be rotatable together with respect to said base member, said rotatable spray head assembly defining an axis of rotation thereof, said rotatably spray head assembly including at least one spray section member, each said spray section member including a sectional conduit means defined there within for receiving water, said spray section member further defining a sectional inlet means in fluid flow communication with said sectional conduit means for facilitating entry of water into said sectional conduit means and a spray nozzle outlet means in fluid flow communication with respect to said sectional conduit means for dispensing water outwardly from the water dispensing device in a decorative pattern, said sectional inlet means being engageable with respect to said coupling outlet means to receive water under pressure therefrom.

2. A water dispensing device for play and amusement for spraying various different patterns of water therefrom as defined in claim 1 wherein said rotatable spray head assembly includes a plurality of said spray section members detachably securable with respect to one another in order to be coincidentally rotatable together with respect to said base member.

3. A water dispensing device for play and amusement for spraying various different patterns of water therefrom as defined in claim 1 wherein said spray nozzle outlet means is oriented to dispense water therefrom in a direction at least partially laterally perpendicular with respect to said axis of rotation of said rotatable spray head assembly in order to urge rotational movement of said rotatable spray head assembly with respect to said base member.

4. A water dispensing device for play and amusement for spraying various different patterns of water therefrom as defined in claim 1 wherein said base conduit means includes a first lateral sector and a second lateral sector thereof with water moving therethrough in opposite directions with respect to one another in order to enhance stability of said base member by minimizing laterally directed forces thereon caused by water traveling through said base conduit means therein laterally.

5. A water dispensing device for play and amusement for spraying various different patterns of water therefrom as defined in claim 4 wherein said base conduit means includes a first longitudinal sector and a second longitudinal sector thereof with water moving therethrough in opposite directions with respect to one another in order to enhance stability of said base member by minimizing longitudinally directed forces thereon caused by water traveling through said base conduit means therein longitudinally.

6. A water dispensing device for play and amusement for spraying various different patterns of water therefrom as defined in claim 5 wherein said first lateral sector is positioned to receive water entering said base conduit through said base inlet means, and wherein said first longitudinal sector is positioned to receive water traveling through said base conduit within said first lateral sector, and wherein said second lateral sector is positioned to receive water traveling through said base conduit within said first longitudinal sector and wherein said second longitudinal sector is positioned to receive water traveling through said base conduit within said second lateral sector.

7. A water dispensing device for play and amusement for spraying various different patterns of water therefrom as defined in claim 1 wherein said rotatable member includes a flange member being capable of selective abutment with said abutment surface responsive to the absence of water movement through said coupling inlet means into said coupling conduit means.

8. A water dispensing device for play and amusement for spraying various different patterns of water therefrom as defined in claim 7 wherein said fixed member of said rotatable coupling means defines said coupling inlet means therewithin and wherein said flange member is positioned extending over said coupling inlet means for closing thereof responsive to being in abutment with said abutment surface of said fixed member of said rotatable coupling means.

9. A water dispensing device for play and amusement for spraying various different patterns of water therefrom as defined in claim 1 wherein said spray nozzle outlet means are adjustable to vary the directional orientation of water dispensed therefrom.

10. A water dispensing device for play and amusement for spraying various different patterns of water therefrom as defined in claim 1 further comprising an auxiliary water device and wherein said base member defines an auxiliary outlet means therein which is selectively attachable to said auxiliary water device for supplying of water thereto.

11. A water dispensing device for play and amusement for spraying various different patterns of water therefrom as defined in claim 1 wherein said rotatable spray head assembly includes:

A. a first spray section member defining a first spray section conduit means therewithin, said first spray section member further defining a first spray section inlet means and a first spray section outlet means in fluid flow communication with respect to said first spray section conduit means, said first spray section inlet means being connected to said coupling outlet means to receive water under pressure therefrom, said first spray section member further defining a first spray nozzle outlet means in fluid flow communication with respect to said first spray section conduit means for dispensing water outwardly therefrom; and B. a second spray section member defining a second spray section conduit means therewithin, said second spray section member further defining a second spray section inlet means and a second spray section outlet means in fluid flow communication with respect to said second spray section conduit means, said second spray section inlet means being connected to said first spray section outlet means to receive water under pressure therefrom, said second spray section member further defining a second spray nozzle outlet means in fluid flow communication with respect to said second spray section conduit means for dispensing water outwardly therefrom.

12. A water dispensing device for play and amusement for spraying various different patterns of water therefrom as defined in claim 11 further comprising a top plug member detachably positionable with respect to said second spray outlet means for sealing thereof.

13. A water dispensing device for play and amusement for spraying various different patterns of water therefrom as defined in claim 1 wherein said rotatable spray head assembly includes:

A. a first spray section member defining a first spray section conduit means therewithin, said first spray section member further defining a first spray section inlet means and a first spray section outlet means in fluid flow communication with respect to said first spray section conduit means, said first spray section inlet means being connected to said coupling outlet means to receive water under pressure therefrom, said first spray section member further defining a first spray nozzle outlet means in fluid flow communication with respect to said first spray section conduit means for dispensing water outwardly therefrom;

B. a second spray section member defining a second spray section conduit means therewithin, said second spray section member further defining a second spray section inlet means and a second spray section outlet means in fluid flow communication with respect to said second spray section conduit means, said second spray section inlet means being connected to said first spray section outlet means to receive water under pressure therefrom, said second spray section member further defining a second spray nozzle outlet means in fluid flow communication with respect to said second spray section conduit means for dispensing water outwardly therefrom; and C. a third spray section member defining a third spray section conduit means therewithin, said third spray section member further defining a third spray section inlet means and a third spray section outlet means in fluid flow communication with respect to said third spray section conduit means, said third spray section inlet means being connected to said second spray section outlet means to receive water under pressure therefrom, said third spray section member further defining a third spray nozzle outlet means in fluid flow communication with respect to said third spray section conduit means for dispensing water outwardly therefrom.

14. A water dispensing device for play and amusement for spraying various different patterns of water therefrom as defined in claim 13 further comprising a top plug member detachably positionable with respect to said third spray outlet means for sealing thereof.

15. A water dispensing device for play and amusement for spraying various different patterns of water therefrom as defined in claim 1 wherein said rotatable spray head assembly includes:

A. a first spray section member defining a first spray section conduit means therewithin, said first spray section member further defining a first spray section inlet means and a first spray section outlet means in fluid flow communication with respect to said first spray section conduit means, said first spray section inlet means being connected to said coupling outlet means to receive water under pressure therefrom, said first spray section member further defining a first spray nozzle outlet means in fluid flow communication with respect to said first spray section conduit means for dispensing water outwardly therefrom;

B. a second spray section member defining a second spray section conduit means therewithin, said second spray section member further defining a second spray section inlet means and a second spray section outlet means in fluid flow communication with respect to said second spray section conduit means, said second spray section inlet means being connected to said first spray section outlet means to receive water under pressure therefrom, said second spray section member further defining a second spray nozzle outlet means in fluid flow communication with respect to said second spray section conduit means for dispensing water outwardly therefrom;

C. a third spray section member defining a third spray section conduit means therewithin, said third spray section member further defining a third spray section inlet means and a third spray section outlet means in fluid flow communication with respect to said third spray section conduit means, said third spray section inlet means being connected to said second spray section outlet means to receive water under pressure therefrom, said third spray section member further defining a third spray nozzle outlet means in fluid flow communication with respect to said third spray section conduit means for dispensing water outwardly therefrom; and D. a fourth spray section member defining a fourth spray section conduit means therewithin, said fourth spray section member further defining a fourth spray section inlet means and a fourth spray section outlet means in fluid flow communication with respect to said fourth spray section conduit means, said fourth spray section inlet means being connected to said third spray section outlet means to receive water under pressure therefrom, said fourth spray section member further defining a fourth spray nozzle outlet means in fluid flow communication with respect to said fourth spray section conduit means for dispensing water outwardly therefrom.

16. A water dispensing device for play and amusement for spraying various different patterns of water therefrom as defined in claim 15 further comprising a top plug member detachably positionable with respect to said fourth spray outlet means for sealing thereof.

17. A water dispensing device for play and amusement for spraying various different patterns of water therefrom as defined in claim 1 wherein said spray section member is movably adjustable to modify orientation of said spray nozzle outlet means in order to control dispensing of water therefrom in a direction laterally perpendicular with respect to said axis of rotation of said rotatable spray head assembly in order to control the speed of rotational movement of said rotatable spray head assembly with respect to said base member.

18. A water dispensing device for play and amusement for spraying various different patterns of water therefrom comprising:

A. a base member defining a base conduit means extending therethrough, said base member further defining a base inlet means and a base outlet means therein in fluid flow communication with respect to said base conduit means to facilitate entry of water into said base conduit means through said base inlet means and to facilitate exit of water therefrom through said base outlet means, said base inlet means being adapted to be connected to a source of water under pressure;

B. a rotatable coupling means secured to said base member and extending outwardly therefrom, said rotatable coupling means defining a coupling conduit means therewithin and a coupling inlet means and a coupling outlet means therein in fluid flow communication with respect to said coupling conduit means, said coupling inlet means being engageable with respect to said base outlet means to receive water under pressure therefrom for entry into said coupling conduit means, said rotatable coupling means further including:

(1) a fixed member adapted to be fixedly secured to said base member, said fixed member defining an abutment surface within said coupling conduit means and further defining said inlet means therewithin; and 2) a rotatable member being movably secured with respect to said fixed member and adapted to contact said abutment surface in the steady state position, said rotatable member being adapted to move out of contact with said abutment surface responsive to water entering said coupling conduit through said coupling inlet means thereof to facilitate rotational movement of said rotatable member with respect to said fixed member and with respect to said base member, said rotatable member including a flange member being capable of selective abutment with said abutment surface responsive to the absence of water movement through said coupling inlet means into said coupling conduit means, said flange member being positioned extending over said coupling inlet means for closing thereof responsive to being in abutment with said abutment surface of said fixed member of said rotatable coupling means; and C. a rotatable spray head assembly being detachably securable with respect to said rotatable member of said rotatable coupling means to be rotatable together with respect to said base member and defining an axis of rotation thereof, said rotatable spray head assembly including a plurality of said spray section members detachably securable with respect to one another in order to be coincidentally rotatable together with respect to said base member, each said spray section member including a sectional conduit means defined there within for receiving water, said spray section member further defining a sectional inlet means in fluid flow communication with said sectional conduit means for facilitating entry of water into said sectional conduit means and a spray nozzle outlet means in fluid flow communication with respect to said sectional conduit means for dispensing water outwardly from the water dispensing device in a decorative pattern, said sectional inlet means being engageable with respect to said coupling outlet means to receive water under pressure therefrom, said spray nozzle outlet means being oriented to dispense water therefrom in a direction at least partially laterally perpendicular with respect to said axis of rotation of said rotatable spray head assembly in order to urge rotational movement of said rotatable spray head assembly with respect to said base member, said spray nozzle outlet means being adjustable to vary the directional orientation of water dispensed therefrom.

19. A water dispensing device for play and amusement for spraying various different patterns of water therefrom comprising:

A. a base member defining a base conduit means extending therethrough, said base member further defining a base inlet means and a base outlet means therein in fluid flow communication with respect to said base conduit means to facilitate entry of water into said base conduit means through said base inlet means and to facilitate exit of water therefrom through said base outlet means, said base inlet means being adapted to be connected to a source of water under pressure, said base member defining an auxiliary outlet means therein, said base conduit means including:

(1) a first lateral sector and a second lateral sector thereof with water moving therethrough in opposite directions with respect to one another in order to enhance stability of said base member by minimizing laterally directed forces thereon caused by water traveling through said base conduit means therein laterally;

(2) a first longitudinal sector and a second longitudinal sector thereof with water moving therethrough in opposite directions with respect to one another in order to enhance stability of said base member by minimizing longitudinally directed forces thereon caused by water traveling through said base conduit means therein longitudinally, said first lateral sector being positioned to receive water entering said base conduit through said base inlet means, said first longitudinal sector being positioned to receive water traveling through said base conduit within said first lateral sector, said second lateral sector being positioned to receive water traveling through said base conduit within said first longitudinal sector, said second longitudinal sector being positioned to receive water traveling through said base conduit within said second lateral sector;

B. a rotatable coupling means secured to said base member and extending outwardly therefrom, said rotatable coupling means defining a coupling conduit means therewithin and a coupling inlet means and a coupling outlet means therein in fluid flow communication with respect to said coupling conduit means, said coupling inlet means being engageable with respect to said base outlet means to receive water under pressure therefrom for entry into said coupling conduit means, said rotatable coupling means further including:

(1) a fixed member adapted to be fixedly secured to said base member, said fixed member defining an abutment surface within said coupling conduit means and further defining said inlet means therewithin; and (2) a rotatable member being movably secured with respect to said fixed member and adapted to contact said abutment surface in the steady state position, said rotatable member being adapted to move out of contact with said abutment surface responsive to water entering said coupling conduit through said coupling inlet means thereof to facilitate rotational movement of said rotatable member with respect to said fixed member and with respect to said base member, said rotatable member including a flange member being capable of selective abutment with said abutment surface responsive to the absence of water movement through said coupling inlet means into said coupling conduit means, said flange member being positioned extending over said coupling inlet means for closing thereof responsive to being in abutment with said abutment surface of said fixed member of said rotatable coupling means;

C. a rotatable spray head assembly being detachably securable with respect to said rotatable member of said rotatable coupling means to be rotatable together with respect to said base member and defining an axis of rotation thereof, said rotatable spray head assembly including a plurality of said spray section members detachably securable with respect to one another in order to be coincidentally rotatable together with respect to said base member, each said spray section member including a sectional conduit means defined there within for receiving water, said spray section member further defining a sectional inlet means in fluid flow communication with said sectional conduit means for facilitating entry of water into said sectional conduit means and a spray nozzle outlet means in fluid flow communication with respect to said sectional conduit means for dispensing water outwardly from the water dispensing device in a decorative pattern, said sectional inlet means being engageable with respect to said coupling outlet means to receive water under pressure therefrom, said spray nozzle outlet means being oriented to dispense water therefrom in a direction at least partially laterally perpendicular with respect to said axis of rotation of said rotatable spray head assembly in order to urge rotational movement of said rotatable spray head assembly with respect to said base member, said spray nozzle outlet means being adjustable to vary the directional orientation of water dispensed therefrom; and D. an auxiliary water device selectively attachable with respect to said auxiliary water device for receiving water supplied thereto under pressure.

* * * * *